US005601288A

United States Patent [19]

White et al.

[11] Patent Number: 5,601,288

[45] Date of Patent: Feb. 11, 1997

[54] CHIPS DOWN BOARD GAME

[76] Inventors: Daniel D. White; Elaine White, both of 19163 Colorado, Roseville, Mich. 48066

[21] Appl. No.: 572,035

[22] Filed: Dec. 14, 1995

[51] Int. Cl.[6] ..... A63F 3/00

[52] U.S. Cl. ..... 273/271

[58] Field of Search ..... 273/236, 242, 273/243, 264, 268, 269, 271

[56] References Cited

U.S. PATENT DOCUMENTS

| | | | |
|---|---|---|---|
| 1,024,194 | 4/1912 | Frank | 273/271 X |
| 1,558,690 | 10/1925 | McCollon | 273/271 |
| 1,564,746 | 12/1925 | Barnard | 273/271 |
| 1,871,247 | 8/1932 | Trost | 273/271 |
| 4,955,619 | 9/1990 | Christman | 273/271 X |
| 5,029,871 | 7/1991 | Willson et al. | 273/271 |
| 5,332,229 | 7/1994 | Fielder et al. | 273/264 X |
| 5,377,992 | 1/1995 | Audet | 273/271 |
| 5,413,350 | 5/1995 | Taylor et al. | 273/271 |

FOREIGN PATENT DOCUMENTS

| | | | |
|---|---|---|---|
| 12671 | 7/1895 | United Kingdom | 273/271 |

OTHER PUBLICATIONS

"Cross Bingo Poker", Spencer Inc., Dale City Florida, Dec. 1992.

*Primary Examiner*—William E. Stoll

[57] ABSTRACT

A game board defining a playing surface that has a plurality of box-like spaces. The box-like spaces have a color and numerical indicia printed thereon. Each box-like space is adjacent at least one other box-like space. Included are a plurality of red chips that have a top side and a bottom side. The red chips are positionable on the box-like spaces of the game board. A plurality of blue chips are included. The blue chips have a top side and a bottom side and are positionable on the box-like spaces of the game board. Lastly, two decks of playing cards are provided. Each deck consisting of a plurality of cards that have an underside. One of the cards of the plurality of cards is pulled from one of the decks of cards. The underside of some of the cards have numerical indicia thereon for matching the numerical indicia on the game board to initiate placement of one of the red or blues chips on the box-like spaces.

1 Claim, 2 Drawing Sheets

CHIPS DOWN BOARD GAME

BACKGROUND OF THE INVENTION

1. Field of the Invention

The present invention relates to a chips down board game and more particularly pertains to playing a game wherein players place chips on a coded board to form rows on the board in order to win the game.

2. Description of the Prior Art

The use of board games is known in the prior art. More specifically, board games heretofore devised and utilized for the purpose of entertainment are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,318,299 to Beaster and Spector discloses a card game board. U.S. Pat. No. 5,228,698 to Dubarry, Jr. discloses a casino board game apparatus. U.S. Pat. No. 5,169,154 to Borghi discloses a casino board game. U.S. No. 5,139,267 to Trevisan discloses a method of playing a racing game. U.S. Pat. No. 4,549,736 to Greitzer discloses a swivel chips and board dispenser for game boards. Lastly, U.S. Pat. No. 4,359,226 to Neff discloses a board game with interrelated cards and chips.

While these devices fulfill their respective, particular objectives and requirements, the aforementioned patents do not describe chips down board game that allows two to six players, ranging in ages from eight to adulthood, to play a fun and easy board game that involves strategically placing colored chips on the game board over box-like spaces.

In this respect, the chips down board game according to the present invention substantially departs from the conventional concepts and designs of the prior art, and in doing so provides an apparatus primarily developed for the purpose of playing a game wherein players place chips on a coded board to form rows on the board in order to win the game.

Therefore, it can be appreciated that there exists a continuing need for a new and improved chips down board game which can be used for playing a game wherein players place chips on a coded board to form rows on the board in order to win the game. In this regard, the present invention substantially fulfills this need.

SUMMARY OF THE INVENTION

In view of the foregoing disadvantages inherent in the known types of board games now present in the prior art, the present invention provides an improved chips down board game. As such, the general purpose of the present invention, which will be described subsequently in greater detail, is to provide a new and improved chips down board game and method which has all the advantages of the prior art and none of the disadvantages.

To attain this, the present invention essentially comprises a game board defining a playing surface that has a plurality of box-like spaces. The playing surface has a center line that divides the game board into two halves. Each box-like space is adjacent at least one other box-like space. Each box-like space has a color and numerical indicia printed thereon. Two of the box-like spaces of the game board have an identical color and numerical indicia. One of the two identical box-like spaces is positioned in one half, while the other of the two identical box-like spaces is positioned in another half of the game board. The game board has four corner spaces with indicia encased within a circle. Included are a plurality of circular chips that are red in color. The red chips that have a top side and a bottom side. The top side of the red chips have a white dot centrally positioned. The red chips are positionable on the box-like spaces of the game board in rows by a game player. Included are a plurality of circular chips that are blue in color. The blue chips have a top side and a bottom side. The top side of the blue chips have a white dot centrally positioned. The blue chips are positionable on the box-like spaces of the game board in rows by the game player. Additionally, two decks of playing cards are provided. Each deck of playing cards consist of a plurality of cards, with each card having an underside. The underside of some of the cards have numerical indicia for matching the numerical indicia on the game board. The underside of the same cards have a color being chosen from the group of colors consisting of red, yellow, blue, and green. One of the cards of the plurality of the cards is pulled from one of the deck of cards. The pulled card matches the numerical indicia and color of any two of the box-like spaces on the game board. The pulled card allows one of the red or blue chips to be placed on the game board in any one of the matching box-like spaces that is unoccupied by one of the chips. Two wild cards are added to each of the two decks. Each wild card has indicia on an underside and allows the addition of red or blue chips to the game board. Two 'take a chip' cards are added to each of the two decks. Each 'take a chip' card has indicia on an underside and allows the removal of red or blue chips to the game board. Lastly, two 'put a chip' cards are added to each of the two decks. The 'put a chip' card has indicia on an underside and allow the addition of red or blue chips.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved chips down board game which has all of the advantages of the prior art board games and none of the disadvantages.

It is another object of the present invention to provide a new and improved chips down board game which may be easily and efficiently manufactured and marketed.

It is further object of the present invention to provide a new and improved chips down board game which is of durable and reliable constructions.

An even further object of the present invention is to provide a new and improved chips down board game which is susceptible of a low cost of manufacture with regard to both materials and labor, and which accordingly is then susceptible of low prices of sale to the consuming public, thereby making such chips down board game economically available to the buying public.

Still yet another object of the present invention is to provide a new and improved chips down board game which provides in the apparatuses and methods of the prior art some of the advantages thereof, while simultaneously overcoming some of the disadvantages normally associated therewith.

Even still another object of the present invention is to provide a chips down board game for playing a game wherein players place chips on a coded board to form rows on the board in order to win the game.

Lastly, it is an object of the present invention to provide a new and improved game board defining a playing surface that has a plurality of box-like spaces. The box-like spaces have a color and numerical indicia printed thereon. Each box-like space is adjacent at least one other box-like space. Included are a plurality of red chips that have a top side and a bottom side. The red chips are positionable on the box-like spaces of the game board. A plurality of blue chips are included. The blue chips have a top side and a bottom side and are positionable on the box-like spaces of the game board. Lastly, two decks of playing cards are provided. Each deck consisting of a plurality of cards that have an underside. One of the cards of the plurality of cards is pulled from one of the decks of cards. The underside of some of the cards have numerical indicia thereon for matching the numerical indicia on the game board to initiate placement of one of the red or blues chips on the box-like spaces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
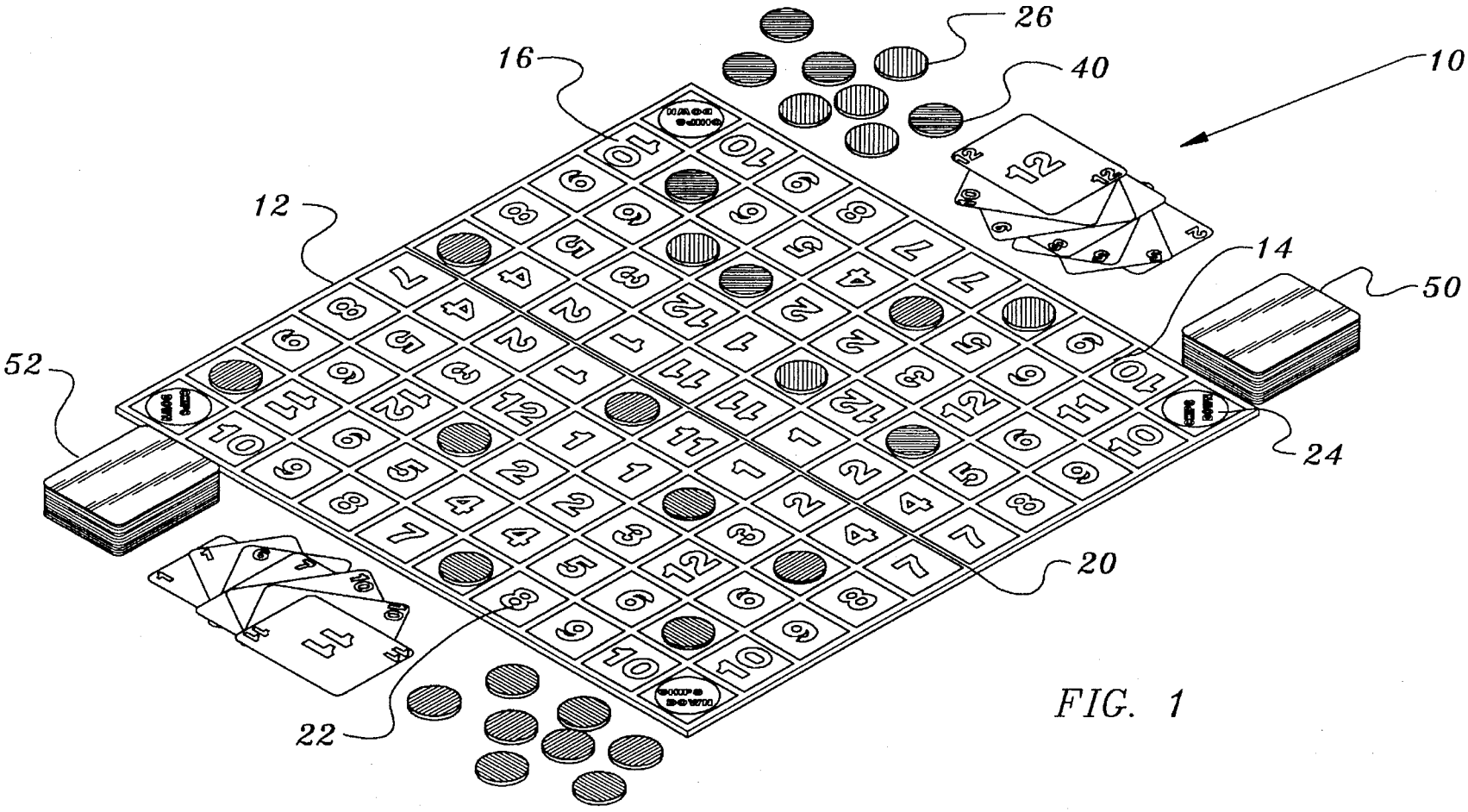
FIG. 1 is a perspective view of the preferred embodiment of the chips down board game constructed in accordance with the principles of the present invention.

With reference now to the drawings, and in particular to FIG. 1 thereof, the preferred embodiment of the new and improved chips down board game embodying the principles and concepts of the present invention and generally designated by the reference numeral 10 will be described.

The present invention, the chips down board game 10 is comprised of a plurality of components. Such components in their broadest context include playing cards, a game board, and chips. Such components are individually configured and correlated with respect to each other so as to attain the desired objective.

Specifically, the present invention includes a game board 12 defining a playing surface 14 that has a plurality of box-like spaces 16. The game board, as shown in FIG. 1, is made from paper or cardboard. The playing surface of the game board has a water resistant finish to increase the useful life of the game board. The playing surface has a center line 20 that divides the game board into two halves.

Also, the center line allows the game board to be folded for storage. Each box-like space is adjacent at least one other box-like space on the game board. Each box-like space has a color and numerical indicia 22 printed thereon. Two of the box-like spaces of the game board have identical color and numerical indicia. One of the two identical box-like spaces is positioned on one half of the game board, while the other of the two identical box-like spaces is positioned on another half of the game board. The game board 12 has four corner spaces 24 with indicia encased within a circle. The box-like spaces of the game board are numbered one through twelve.

On each half of the game board there are four groupings of the box-like spaces numbering one through twelve. Each grouping on one of the halves has a color. The color is chosen from the group of colors consisting of red, yellow, blue, and green. The other half of the game board has four numbered groupings within the box-like spaces in each group numbering one through twelve and having a color chosen from the same group of colors. The four center box-like spaces, that are near the center line 20, all have numerical indicia that is the number eleven. The four corner spaces 24 of the game board have the four colors outside the circle. These colors match the colors of the game board.

Figure 6:
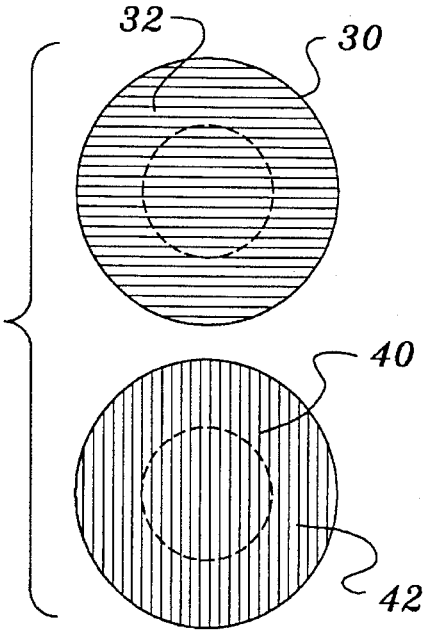
FIG. 6 is a top plane view of the chips of the present invention.
Figure 7:
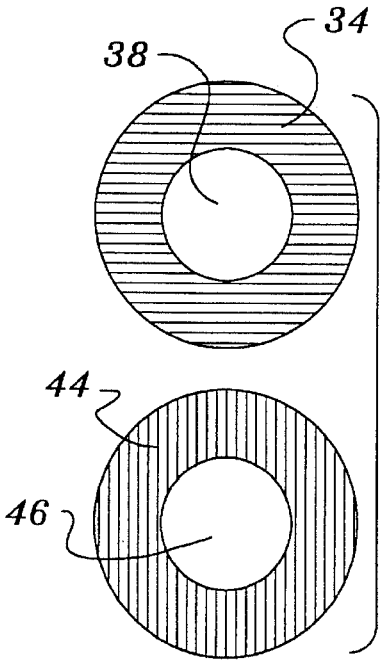
FIG. 7 is a bottom plane view of the chips of the present invention.

As best illustrated in FIG. 6, a plurality of circular chips are provided. The chips are red in color 30. The med chips have a top side 32 and a bottom side 34. The top side of the red chip has a white dot 38 that is centrally positioned. The red chip is to be positioned on the box-like spaces 16 of the game board 12 in rows by a player.

Another plurality of chips are included. These chips are blue 40 in color. The blue chips have a top side 42 and a bottom side 44. The top side of the blue chips have a white dot 46 centrally positioned. The blue chips are for positioning on the box-like spaces 16 of the game board 12 in rows by the game player. The plurality of chips, whether they are blue or red, are formed of a rigid plastic that is lightweight and durable. The color on the chips is not painted, but is pre-blended with the plastic in the formation of the chips.

Figure 2:
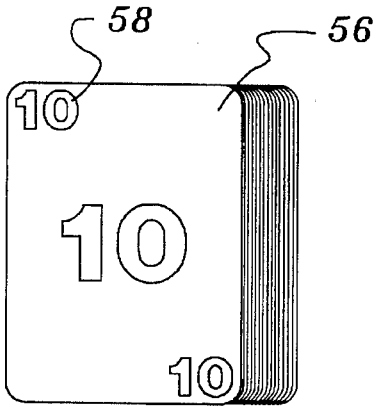
FIG. 2 is a bottom plane view of the playing cards of the present invention.

FIG. 1 shows two decks of playing cards 50 and 52 are provided. Each deck of playing cards consist of a plurality of cards, each card has an underside 56. The underside of some cards have numerical indicia 58, as shown in FIG. 2, for matching the numerical indicia on the game board. The underside of the same cards have a color that is chosen from the group of colors consisting of red, yellow, blue, and green. One of the cards, of the plurality of the cards, is pulled from one of the decks by a player. The pulled card will match the numerical indicia and color of any two of the box-like spaces 16 on the game board 12. The pulled card allows one of the red or blue chips to be placed on the game board 12, in any one of the matching box-like spaces that is unoccupied by a chip. There is no required space other than the space that matches the choice shown on the playing card. The space to place the chip is determined by the player that pulled the card. The playing cards that make up the decks are formed of paper and have a plastic-like coating thereon. The cards are made in the manner commercially available for making playing cards.

Figure 3:
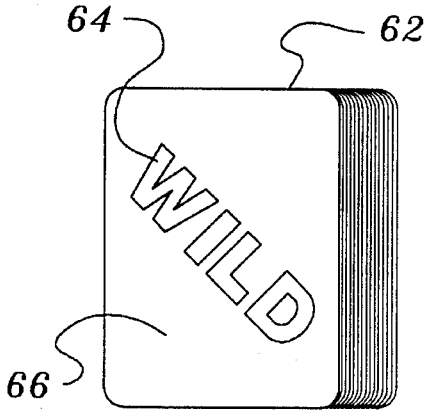
FIG. 3 is a bottom plane view of the wild cards of the present invention.

FIG. 3 shows a deck of wild cards 62. Two wild cards are chosen from this deck and added to each of the two decks. Each wild card has indicia 64 on an underside 66 of the wild card. The indicia on the wild cards, as shown in FIG. 3, is the word wild in bold capital letters. Each wild card allows the addition of one red or blue chips to the game board. The player that chooses the wild card from the deck of playing cards is allowed to place the chip anywhere on the game board.

Figure 4:
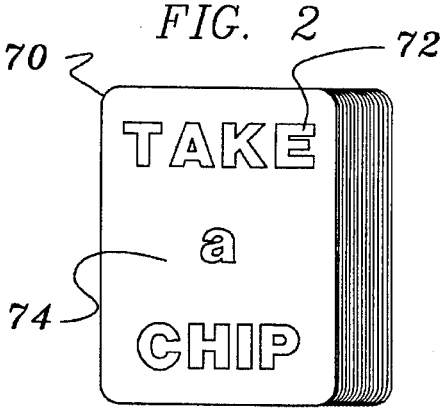
FIG. 4 is a bottom plane view of the 'take a chip' cards of the present invention.

Additionally, as shown in FIG. 4, a deck of 'take a chip' cards 70 is included. Two of the 'take a chip' cards are added to each of the two decks. Each 'take a chip' card has indicia 72 on an underside 74. The indicia are the words take a chip in large capital letters. Each 'take a chip' card allows the removal of one of the red or blue chips. The player that pulls the 'take a chip' card from one of the decks decides which chip of the opposing player is removed from the game board.

Figure 5:
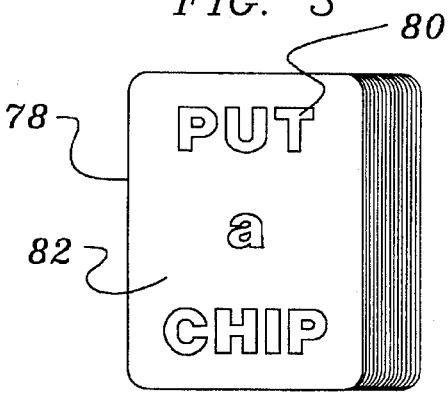
FIG. 5 is a bottom plane view of the 'put a chip' cards of the present invention.

Lastly, 'put a chip' cards 78 are provided. As shown in FIG. 5, two of the 'put a chip' cards are added to each of the two decks 50 and 52. The 'put a chip' card has indicia 80 on an underside 82. The indicia on each 'put a chip' card are the words put a chip in bold capital letters. Each of the 'put a chip' cards is capable of allowing the addition of one of the red or blue chips to the game board in any vacant spot.

Game play begins by choosing two or more players for game play. When there are more than two players, with a number of players being an even number, teams are formed. Once the teams or players are chosen, each team or player is distributed chips. Red chips are distributed to one player or team. Blue chips are distributed to the other player or team. The chips are distributed in a proportionate amount, with each team or player having the same number of chips. The game board is placed in the middle of the players or teams. The game comes with a plurality of playing cards. The cards are distributed in a set amount to each player of the game. If there are two players, each player gets seven cards, four players, each player gets five cards, and if there are six players, each player gets four cards. Once the cards are distributed to the players, a deck is placed near each player or near each team.

Play begins by having a first player choose a playing card from the cards that he/she has in their hand. The chosen playing card is placed face up on the table for all players to see. The card will have on its underside, a number and color that matches one of the box-like spaces of the game board. The player chooses one of the two box-like spaces that are available and places his/her chip on the box-like space with the dot face down on the space. After each play of a card the player draws a card from his/her deck of cards and places it in his/her hand. Each player performs that same task until the last player has taken a turn and pulled card from his hand.

The cards played are going to have a number and a color or they're going to be one of the wild cards, take a chip cards, or put a chip cards. Instructions on the underside of the card, determines what form of action the game player will take. If the card is a numerical card with a color, then the game player is going to place a red or blue chip on the game board.

The act of pulling a card from the deck continues clockwise to each player. This process of pulling a card from the deck and then placing the chip on the game board is repeated until one of the players or team places his/her chips in three rows on the game board. The rows may be across, diagonal, or up and down.

The following set of rules are provided as the preferred manner of playing the game. However, variation of rules and manner of playing the game are within the scope of this invention.

Game components

Chips Down game board chips—50 red, 50 blue. The chips have white dots on one side, to distinguish one side from the other.

2 decks of playing cards. 1 deck with a red backing and 1 deck with a blue backing. Cards are numbered 1 through 12 in four colors: red, yellow, blue, and green. Each deck also included 2 wild cards; 2 "take a chips" cards; and 2 "put a chip" cards.

Game Play

Chips Down may be played by 2, 4, or 6 players, divided into 2 teams. Team players will be seated in alternate positions around the board.

Object

To get 5 chips in a row, either vertically, horizontally, or diagonally across the board. The first team to get 3 rows completed wins the game.

How to Play

Chips are distributed equally to players, each team using a different color.

Team dealers distribute the cards as follows:

2 players—7 cards 4 players—5 cards 6 players—4 cards

The remaining cards are placed in piles within reach of team players.

The first player places a card from his hand, face up, on the table; then puts a chip, dot side down, on a square matching the color and number of his card. After each turn, the player draws a new card from the top of his deck to add to his hand. (Notice that the board has 2 spaces that match each numbered card. It is wise to locate each one before deciding which to play on.)

Play continues clockwise around the table. When one team makes a row (consisting of 5 chips in a row) they will turn the chips over to the dotted side. Dotted chips cannot be removed by any card.

The person or team that first completes 3 rows is the winner.

Special Rules

"Wild" corners on the board can be used by either team, and count as one of your 5 chips.

"Take a Chip" cards are played to remove 1 of the opponent's chips.

"Put a Chip" cards are played to put a chip on any vacant spot on the board.

"Wild" cards are played for placing a chip anywhere on the board, removing a chip anywhere on the board, or removing an opponent's chips and placing your chip on that space.

Dotted chips cannot be removed by any card.

You may reuse chips from a previous row to make another row. 2 players: Each player uses their own deck of cards and chips. Draw to 7 cards.

4 players: Players 1 and 3 are one team and 2 and 4 are another. Each team uses one set of chips. Players 1 and 3 will deal first. Each using a separate deck of cards. Players 1 and 2 use one deck, and players 3 and 4 use the other deck of cards.

6 players: Players 1, 3 and 5 are one team, and players 2, 4, and 6 are the other team. Players 1 and 4 will deal first.

Players 1, 2 and 3 will use one deck of cards, and players 4, 5 and 6 will use the other deck of cards.

If scoring: You will receive 25 points per completed row. The winning team receives an extra 50 points as a bonus. Play up to 500 points.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved chips down board game for play by two or more players comprising in combination:

a game board defining a playing surface having a plurality of box-like spaces thereon, the playing surface having a center line capable of dividing the game board into two halves, each half of the game board having four groupings of box-like spaces having numerical indicia numbering one through twelve, each box-like space within one of the four groupings of box-likes spaces being adjacent at least one other box-like space, each of the four groupings of box-like spaces on each half having a different color, the color of each grouping of box-like spaces being chosen form the group of colors consisting of red, yellow, blue and green, two of the box-like spaces of the game board having an identical color and numerical indicia, one of the two identical box-like spaces being positioned in one half while the other of the two identical box-like spaces being positioned in another half of the game board, the game board having four corner spaces with indicia encased within a circle, the game board having four center box-like spaces with each center box-like spaces having identical numerical indicia thereon;

a plurality of red circular chips, the red chips having a top side and a bottom side, the top side of the red chip having a white dot centrally positioned thereon, the red chips for positioning on the box-like spaces of the game board in rows by a game player;

a plurality of blue circular chips, the blue chips having a top side and a bottom side, the top side of the blue chip having a white dot centrally positioned thereon, the blue chips for positioning on the box-like spaces of the game board in rows by the game player;

two decks of playing cards, each deck of playing cards consisting of a plurality of cards with each card having an underside, the underside of some of the cards having numerical indicia thereon numbering one through twelve for matching the numerical indicia on the game board, the underside of the same cards having a color being chosen form the group of colors consisting of red, yellow, blue and green, one of the cards of the plurality of cards capable of being pulled from one of the decks of cards, the pulled card capable of matching the numerical indicia and color of any two of the box-like spaces within one of the four groupings of box-like spaces on the game board, the pulled card capable of allowing one of the red or blue chips to be placed on the game board in any one of the matching box-like spaces being unoccupied by one of the chips;

two wild cards being added to each of the two decks and having indicia on an underside thereof, each wild card capable of allowing the addition of one of the red or blue chips;

two take a chip cards being added to each of the two decks and having indicia on an underside thereof, each take a chip card capable of allowing the removal of one of the red or blue chips; and two put a chip cards being added to each of the two decks and having indicia on an underside thereof, each put a chip card capable of allowing the addition of one of the red or blue chips.

* * * * *